US005975435A

United States Patent [19]

Whited, II

[11] Patent Number: 5,975,435

[45] Date of Patent: Nov. 2, 1999

[54] ADJUSTABLE AIR BRUSH FOR SPRAY PAINT CANS

[76] Inventor: Sherman E. Whited, II, 1074 22nd St., Sarasota, Fla. 34234

[21] Appl. No.: 08/515,939

[22] Filed: Aug. 16, 1995

[51] Int. Cl.[6] ..... B05B 1/30; B05B 7/24

[52] U.S. Cl. ..... 239/583; 239/337; 239/346; 222/285; 222/509

[58] Field of Search ..... 239/337, 581.2, 239/583, 346, 340; 222/285, 402.1, 402.25, 509

[56] References Cited

U.S. PATENT DOCUMENTS

| | | | |
|---|---|---|---|
| 2,670,239 | 2/1954 | Ditch | 239/583 X |
| 3,433,420 | 3/1969 | Strout | 239/581.2 X |
| 4,161,289 | 7/1979 | Rebold | 239/346 |
| 5,421,518 | 6/1995 | Robisch et al. | 239/340 X |

*Primary Examiner*—Andres Kashnikow
*Assistant Examiner*—Sean P. O'Hanlon

[57] ABSTRACT

An adjustable air brush for spray paint cans comprised of a tube portion having an open internally threaded first end and a closed second end with an intermediate extent therebetween. The tube portion has a small tube extending orthogonally downward from an interior surface thereof. The small tube is adapted for coupling with a nozzle hole of a spray can. The tube portion has a pressure knob secured to a top portion thereof. The pressure knob has a tube extending within the tube portion to couple with the small tube to release paint from within the spray can. A spray tip portion removably secures to one of the open end portions of the tube portion. An adjustable knob portion secures to an opposing end portion of the tube portion. The adjustment knob regulates the amount of paint through the tip portion.

1 Claim, 4 Drawing Sheets

ADJUSTABLE AIR BRUSH FOR SPRAY PAINT CANS

BACKGROUND OF THE INVENTION

1. Field of the Invention

The present invention relates to an adjustable air brush for spray paint cans and more particularly pertains to applying paint in an airbrushing manner easily, evenly, and quickly with an adjustable air brush for spray paint cans.

2. Description of the Prior Art

The use of spray heads is known in the prior art. More specifically, spray heads heretofore devised and utilized for the purpose of permitting spraying of liquids, such as paint are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,193,748 to Wittersheim et al. discloses a spray head for spray device.

U.S. Pat. No. Des. 333,616 to Perkins et al. discloses the ornamental design for a detachable spray nozzle for spray cans.

U.S. Pat. No. 4,095,286 to Ellis discloses an agitator for paint spray cans.

U.S. Pat. No. 4,024,990 to Smrt discloses a dispensing apparatus for aerosol spray cans.

U.S. Pat. No. 3,659,791 to Clark discloses a spray gun adaptor for aerosol cans.

While these devices fulfill their respective, particular objective and requirements, the aforementioned patents do not describe an adjustable air brush for spray paint cans for applying paint in an airbrushing manner easily, evenly, and quickly.

In this respect, the adjustable air brush for spray paint cans according to the present invention substantially departs from the conventional concepts and designs of the prior art, and in doing so provides an apparatus primarily developed for the purpose of applying paint in an airbrushing manner easily, evenly, and quickly.

Therefore, it can be appreciated that there exists a continuing need for new and improved adjustable air brush for spray paint cans which can be used for applying paint in an airbrushing manner easily, evenly, and quickly. In this regard, the present invention substantially fulfills this need.

SUMMARY OF THE INVENTION

In the view of the foregoing disadvantages inherent in the known types of spray heads now present in the prior art, the present invention provides an improved adjustable air brush for spray paint cans. As such, the general purpose of the present invention, which will be described subsequently in greater detail, is to provide a new and improved adjustable air brush for spray paint cans and method which has all the advantages of the prior art and none of the disadvantages.

To attain this, the present invention essentially comprises a tube portion having an open internally threaded first end, a closed second end, and an intermediate extent therebetween. The tube portion has a small tube extending orthogonally downwardly from an interior surface thereof. The small tube is adapted for coupling with a nozzle hole of a spray can. The tube portion has a pressure knob secured to a top portion of the intermediate extent thereof. The pressure knob has a tube extending within the tube portion to couple with the small tube to release paint from within the spray can. The closed second end has a threaded aperture formed therethrough. The device contains a spray tip portion having a first section and a second section. The first section has an externally threaded open first end and an internally threaded open second end. The externally threaded open first end removably secures to the open internally threaded first end of the tube portion. The second section has an externally threaded open first end and an open second end. The externally threaded open first end of the second section removably secures to the internally threaded open second end of the first section. The device contains an adjustable knob portion having a securement portion, a knob portion, and a spring portion. The securement portion has an externally threaded first end removably secured to the internally threaded aperture through the closed second end of the tube portion. The securement portion has a threaded aperture formed through the first end and extends outwardly of a second end. The knob portion has a threaded portion coupling with the threaded aperture of the securement portion. The spring portion secures around the threaded portion of the knob portion for biasing thereof. The threaded portion has an inner rod secured thereto. The inner rod extends within the tube portion. The inner rod has a tip portion extending outwardly of the open first end of the tube for regulation of paint through the spray tip portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable air brush for spray paint cans which has all the advantages of the prior art spray heads and none of the disadvantages.

It is another object of the present invention to provide a new and improved adjustable air brush for spray paint cans which may be easily and efficiently manufactured and marketed.

It is a further object of the present invention to provide a new and improved adjustable air brush for spray paint cans which is of durable and reliable construction.

An even further object of the present invention is to provide a new and improved adjustable air brush for spray paint cans which is susceptible of a low cost of manufacture with regard to both materials and labor, and which accordingly is then susceptible of low prices of sale to the consuming public, thereby making such an adjustable air brush for spray paint cans economically available to the buying public.

Still yet another object of the present invention is to provide a new and improved adjustable air brush for spray paint cans which provides in the apparatuses and methods of the prior art some of the advantages thereof, while simultaneously overcoming some of the disadvantages normally associated therewith.

Even still another object of the present invention is to provide a new and improved adjustable air brush for spray paint cans for applying paint in an airbrushing manner easily, evenly, and quickly.

Lastly, it is an object of the present invention to provide a new and improved adjustable air brush for spray paint cans comprised of a tube portion having an open internally threaded first end and a closed second end with an intermediate extent therebetween. The tube portion has a small tube extending orthogonally downward from an interior surface thereof. The small tube is adapted for coupling with a nozzle hole of a spray can. The tube portion has a pressure knob secured to a top portion thereof. The pressure knob has a tube extending within the tube portion to couple with the small tube to release paint from within the spray can. A spray tip portion removably secures to one of the open end portions of the tube portion. An adjustable knob portion secures to an opposing end portion of the tube portion. The adjustment knob regulates the amount of paint passing through the tip portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
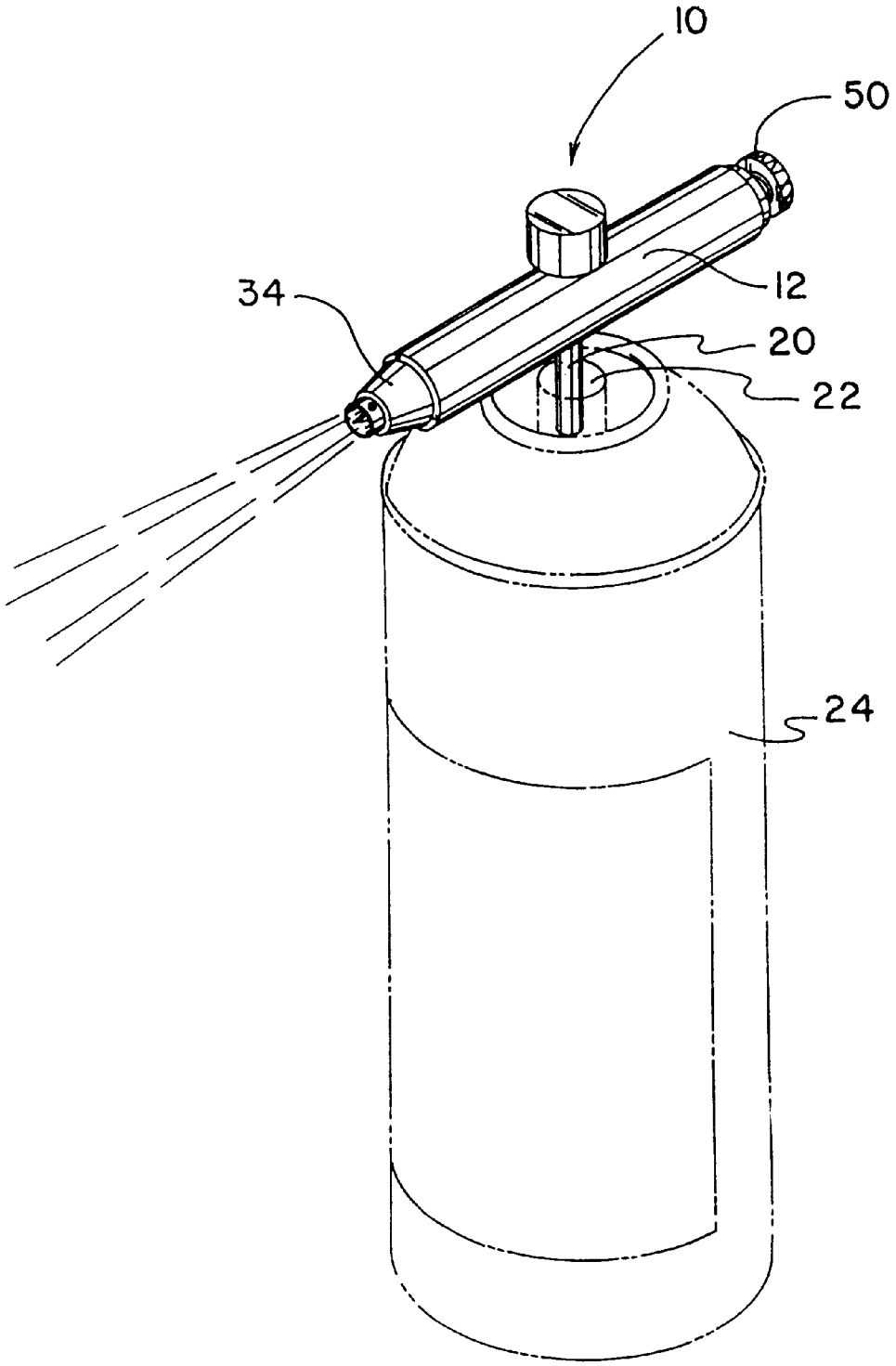
FIG. 1 is a perspective view of the preferred embodiment of the adjustable air brush for spray paint cans constructed in accordance with the principles of the present invention.
Figure 2:
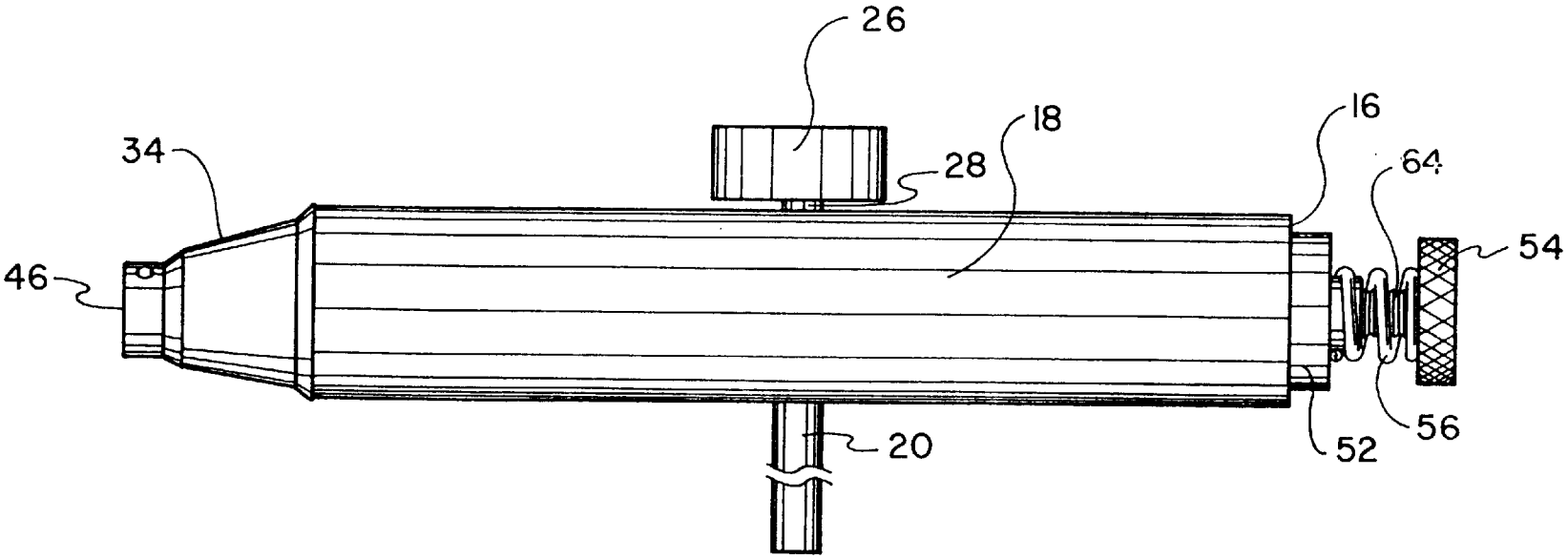
FIG. 2 is a side elevation view of the present invention.
Figure 3:
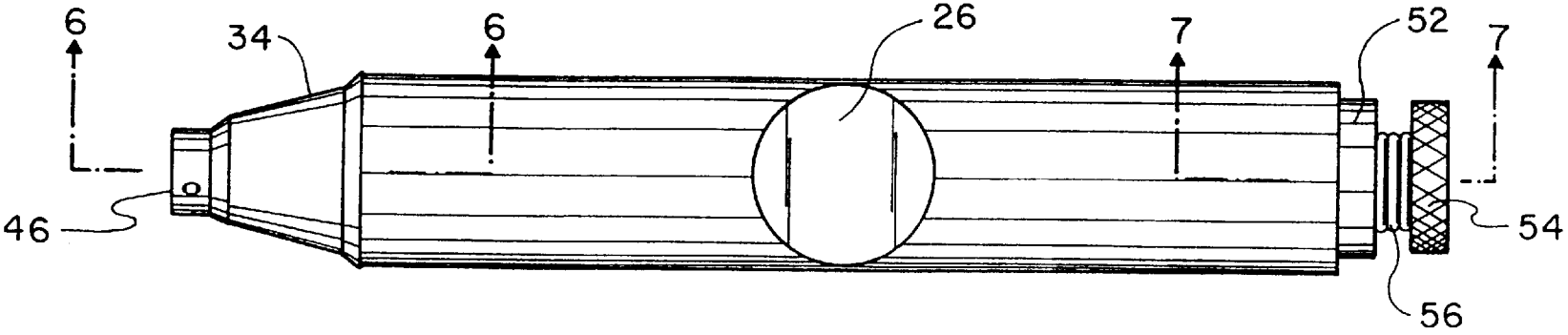
FIG. 3 is a plan view of the preferred embodiment of the present invention.
Figure 5:
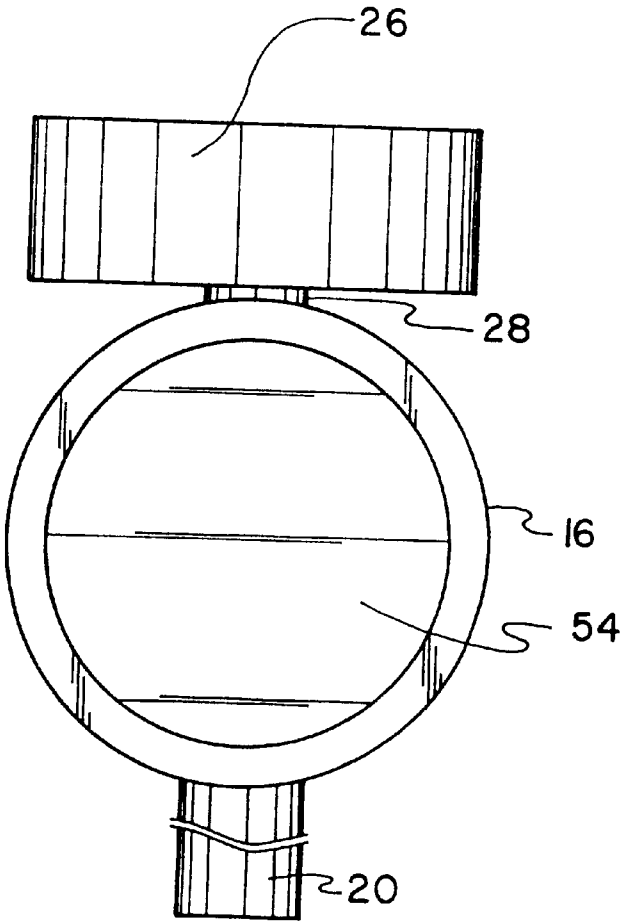
FIG. 5 is a rear elevation view of the present invention.
Figure 4:
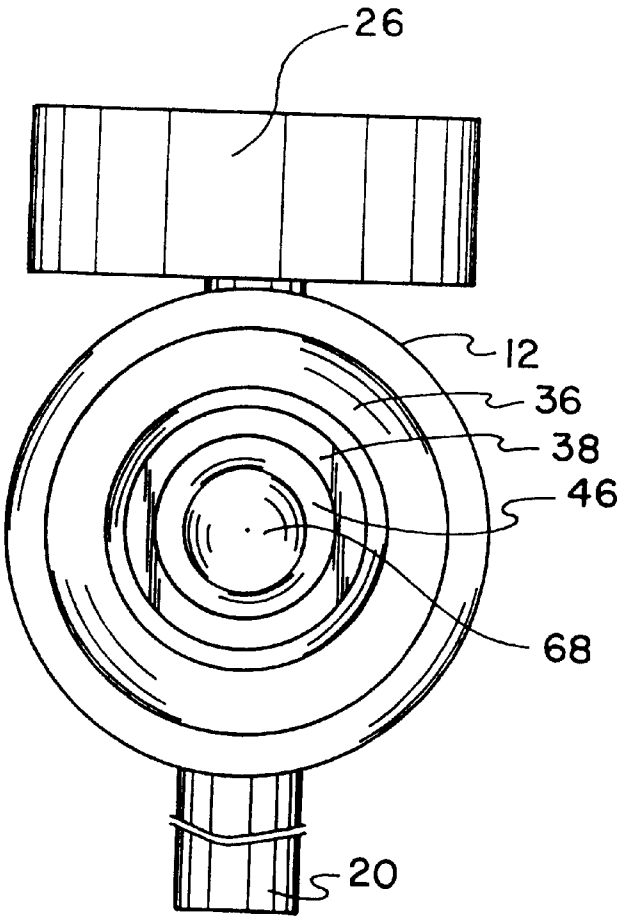
FIG. 4 is a front elevation view of the present invention.
Figure 6:
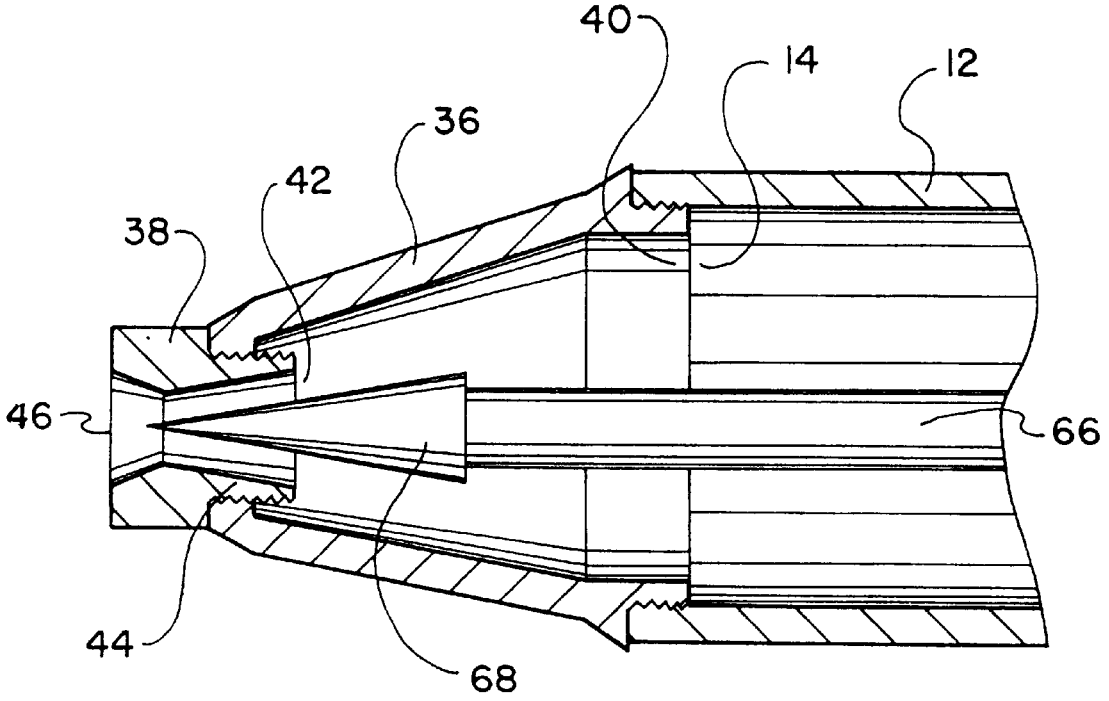
FIG. 6 is a cross-sectional view as taken along line 6—6 of FIG. 3.
Figure 7:
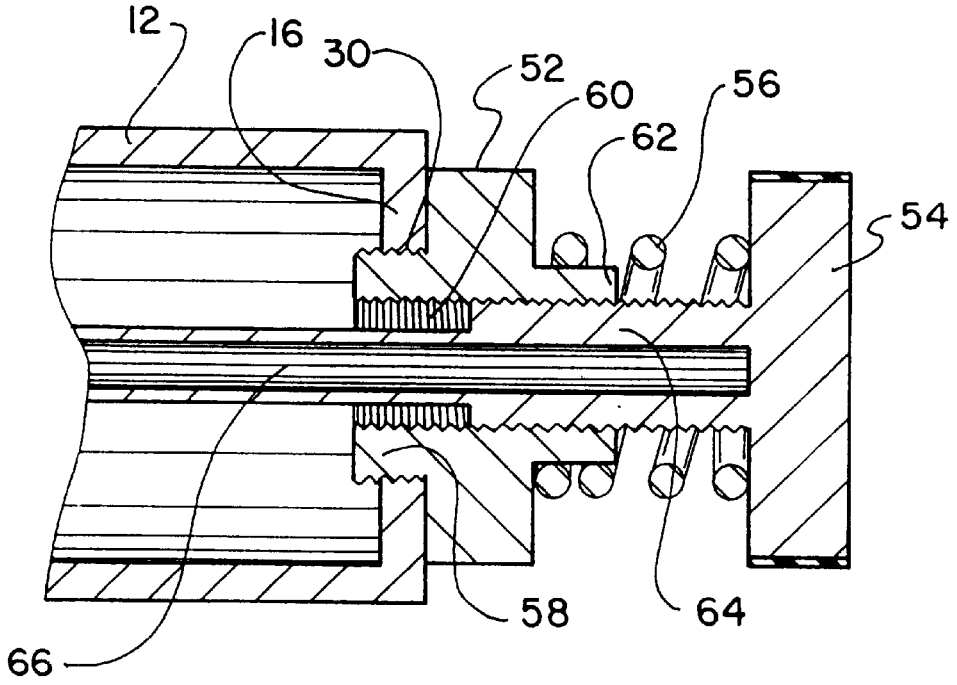
FIG. 7 is a cross-sectional view as taken along line 7—7 of FIG. 3.

With reference now to the drawings, and in particular, to FIGS. 1–7 thereof, the preferred embodiment of the new and improved adjustable air brush for spray paint cans embodying the principles and concepts of the present invention and generally designated by the reference number 10 will be described.

Specifically, it will be noted in the various Figures that the device relates to an adjustable air brush for spray paint cans for applying paint in an airbrushing manner easily, evenly and quickly. In its broadest context, the device consists of a tube portion, a spray tip portion, and an adjustable knob portion.

The device 10 contains a tube portion 12 having an open internally threaded first end 14, a closed second end 16, and an intermediate extent 18 therebetween. The tube portion 12 has a small tube 20 extending orthogonally downwardly from an interior surface thereof. The small tube 20 is adapted for coupling with a nozzle hole 22 of a spray can 24. The tube portion 12 has a pressure knob 26 secured to a top portion of the intermediate extent 18 thereof. The pressure knob 26 has a tube 28 extending within the tube portion 12 to couple with the small tube 20 to release paint from within the spray can 24. By depressing the pressure knob 26, the tube 28 causes the small tube 20 to release the paint upwardly from within the spray can 24 and into the tube portion 12. The closed second end 16 has a threaded aperture 30 formed therethrough.

The device 10 contains a spray tip portion 34 having a first section 36 and a second section 38. The first section 36 has an externally threaded open first end 40 and an internally threaded open second end 42. The externally threaded open first end 40 removably secures to the open internally threaded first end 14 of the tube portion 12. The second section 38 has an externally threaded open first end 44 and an open second end 46. The externally threaded open first end 44 of the second section 38 removably secures to the internally threaded open second end 42 of the first section 36. The second section 38 permits the paint from within the tube portion 12 to exit outwardly and onto a desired surface. The first section 36 and the second section 38 are easily detachable from the tube portion 12 and from each other to allow for their cleaning.

The device 10 contains an adjustable knob portion 50 having a securement portion 52, a knob portion 54, and a spring portion 56. The securement portion 52 has an externally threaded first end 58 removably secured to the internally threaded aperture 30 through the closed second end 16 of the tube portion 12. The securement portion 52 has a threaded aperture 60 formed through the first end 58 and extends outwardly of a second end 62. The knob portion 54 has a threaded portion 64 coupling with the threaded aperture 60 of the securement portion 52. The spring portion 56 secures around the threaded portion 60 of the knob portion 54 for biasing thereof. The spring portion 56 provides resistance to the user as he/she adjusts the knob portion 54 thereby controlling the ease at which the knob portion 54 is turned. The threaded portion 64 has an inner rod 66 secured thereto. The inner rod 66 extends within the tube portion 12. The inner rod 66 has a tip portion 68 extends outwardly of the open first end 14 of the tube 12 for regulation of paint through the spray tip portion 34. Turning the knob portion 54 causes the inner rod 66 to move closer to or further away from the spray tip portion 34 thereby controlling the amount of paint being emitted from the tube portion 12. The closer the tip portion 68 is to the spray tip portion 34, lesser paint will be emitted. The further the tip portion 68 of the inner rod 66 is away from the spray tip portion 34, more paint will be emitted. As with other parts of the device 10, the adjustable knob portion 50 is easily removed and broken down to allow for the proper cleaning.

The present invention is a spray paint can 24 attachment which replaces the existing nozzle, enabling the artist to apply the paint in an airbrushing manner easily, evenly, and quickly.

It features a center, perpendicular tube 20 which fits inside the nozzle hole 22 of the spray can 24. One end of the attachment includes a two-sectioned airbrush tip portion 34 through which the paint is emitted. The opposite end of the tube features an adjustable knob portion 50 which enables the user to control the amount of paint dispersed by the tip portion 34. This knob portion 50 is connected to the tip portion 34 by an inner rod 66 which regulates the size of the tip portion 34 opening. An additional pressure knob 26 centrally located along the top of the device 10 functions as the pressure nozzle which releases the paint from within the spray can 24.

The existing nozzle upon a standard spray can 24 is removed and replaced by the device 10. The small tube 20, extending from the center of the device 10 is inserted into the nozzle hole 22 and firmly secured in place. Depending upon the needs of the artist, the adjustable knob portion 50 along the back of the device 10 is twisted, according to the amount of paint to be released. Pressure is then applied to the pressure knob 26 and the contained paint is emitted through the spray tip portion 34. After use, the tip portion 34 is separated and the entire unit cleaned.

This device 10 replaces existing methods of airbrushing techniques and is conveniently used upon any spray paint can 24 without the need of additional, expensive equipment. The device 10 makes spray painting a more accurate art.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved adjustable air brush for spray paint cans for applying paint in an airbrushing manner easily, evenly, and quickly comprising, in combination:

a tube portion having an open internally threaded first end and a closed second end with an intermediate extent therebetween, the tube portion having a small tube extending orthogonally downwardly from an interior surface thereof, the small tube being adapted for coupling with a nozzle hole of a spray can, the tube portion having a pressure knob secured to a top portion of the intermediate extent thereof, the pressure knob having a tube extending within the tube portion to couple with the small tube to release paint from within the spray can, the closed second end having a threaded aperture formed therethrough;

a spray tip portion having a first section and a second section, the first section having an externally threaded open first end and an internally threaded open second end, the externally threaded open first end removably securing to the open internally threaded first end of the tube portion, the second section having an externally threaded open first end and an open second end, the externally threaded open first end of the second section removably securing to the internally threaded open second end of the first section, the interior of the second section being of a reduced circular diameter at its intermediate extent and with a greater circular diameter at its interior and exterior ends thereby forming an interior cone and exterior cone;

an adjustable knob portion having a securement portion, a knob portion, and a spring portion, the securement portion having an externally threaded first end removably securing to the internally threaded aperture through the closed second end of the tube portion, the securement portion having a threaded aperture formed through the first end and extending outwardly of a second end, the knob portion having a threaded portion coupling with the threaded aperture of the securement portion, the spring portion being externally positioned around the threaded portion of the knob portion for biasing thereof, the threaded portion of the rod having an inner rod secured thereto, the inner rod extending entirely through and beyond both ends of the tube portion, the inner rod having a cone-shaped tip portion extending outwardly of the open first end of the tube and axially adjustable within the interior cone for regulation of paint through the spray tip portion.

* * * * *